US010041185B2

(12) United States Patent
Sukenari

(10) Patent No.: US 10,041,185 B2
(45) Date of Patent: Aug. 7, 2018

(54) CYLINDER PLATING APPARATUS AND METHOD

(71) Applicant: THINK LABORATORY CO., LTD., Chiba (JP)

(72) Inventor: Kazuhiro Sukenari, Chiba (JP)

(73) Assignee: THINK LABORATORY CO., LTD., Chiba (JP)

( * ) Notice: Subject to any disclaimer, the term of this patent is extended or adjusted under 35 U.S.C. 154(b) by 148 days.

(21) Appl. No.: 15/125,314

(22) PCT Filed: Feb. 26, 2015

(86) PCT No.: PCT/JP2015/055568

§ 371 (c)(1),
(2) Date: Sep. 12, 2016

(87) PCT Pub. No.: WO2015/151665

PCT Pub. Date: Oct. 8, 2015

(65) Prior Publication Data

US 2017/0073833 A1 Mar. 16, 2017

(30) Foreign Application Priority Data

Mar. 31, 2014 (JP) ..... 2014-072093

(51) Int. Cl.
*C25D 17/12* (2006.01)
*C25D 7/04* (2006.01)
(Continued)

(52) U.S. Cl.
CPC ..... *C25D 17/12* (2013.01); *C25D 3/04* (2013.01); *C25D 3/38* (2013.01); *C25D 5/04* (2013.01);
(Continued)

(58) Field of Classification Search
CPC ..... C25D 17/12; C25D 7/04
See application file for complete search history.

(56) References Cited

U.S. PATENT DOCUMENTS 1,918,627 A * 7/1933 Ballard ..... B41C 1/00 204/212
4,136,002 A * 1/1979 Bober ..... C25D 7/04 204/225

(Continued)

FOREIGN PATENT DOCUMENTS

CN 102933752 A 2/2013
DE 23 09 643 A1 9/1973

(Continued)

*Primary Examiner* — Bryan D. Ripa
(74) *Attorney, Agent, or Firm* — McGlew and Tuttle, P.C.

(57) ABSTRACT

Provided are a cylinder plating apparatus and a cylinder plating method, in which the distance between an insoluble electrode and a cylinder to be processed can be kept constant regardless of the diameter of the cylinder to be processed, and the surface area of the insoluble electrode is increased to reduce the current density of the insoluble electrode, thereby being capable of reducing burden on the insoluble electrode. The cylinder plating apparatus is configured to plate an outer peripheral surface of the cylinder to be processed in such a manner that a pair of the insoluble electrodes each having a shape in which at least a lower part thereof is curved inward and being constructed such that at least the lower part has a comb-like portion are brought close to both side surfaces of the cylinder to be processed with predetermined intervals. The insoluble electrodes face each other in a staggered pattern so that projections of the comb-like portion of one of the insoluble electrodes are located at positions of recesses of the comb-like portion of another one of the insoluble electrodes. The insoluble electrode is configured to rotate about an upper end of the insoluble electrode so that the distance of closeness of the (Continued)

insoluble electrode to the outer peripheral surface of the cylinder to be processed is adjustable depending on the diameter of the cylinder to be processed.

15 Claims, 7 Drawing Sheets

(51) Int. Cl.

| | |
|---|---|
| ***C25D 7/00*** | (2006.01) |
| ***C25D 3/04*** | (2006.01) |
| ***C25D 3/38*** | (2006.01) |
| ***C25D 5/04*** | (2006.01) |
| ***C25D 17/06*** | (2006.01) |

(52) U.S. Cl.
CPC ..... *C25D 7/00* (2013.01); *C25D 7/04* (2013.01); *C25D 17/06* (2013.01)

(56) References Cited

U.S. PATENT DOCUMENTS

| | | | | |
|---|---|---|---|---|
| 5,925,231 | A * | 7/1999 | Metzger | C25D 7/04 205/127 |
| 2009/0095633 | A1* | 4/2009 | Inoue | B41N 3/032 205/143 |
| 2013/0161196 | A1* | 6/2013 | Shigeta | C25D 7/04 205/95 |

FOREIGN PATENT DOCUMENTS

| | | | |
|---|---|---|---|
| EP | 2623647 | A1 | 8/2013 |
| EP | 2 660 363 | A2 | 11/2013 |
| JP | 7-41980 | A | 2/1995 |
| KR | 10-2013-0100063 | A | 9/2013 |
| WO | 2012/043514 | A1 | 4/2012 |

* cited by examiner

CYLINDER PLATING APPARATUS AND METHOD

TECHNICAL FIELD

The present invention relates to a cylinder plating apparatus and a cylinder plating method for plating an outer peripheral surface of a long and hollow roll through use of an insoluble electrode when manufacturing, for example, a hollow and tubular gravure cylinder (also referred to as "plate-making roll") to be used for gravure printing.

BACKGROUND ART

In gravure printing, minute recesses (cells) are formed in a hollow and tubular cylinder to be processed based on plate-making information to produce a printing surface, and the cells are filled with ink so that the ink is transferred onto an object to be printed. In general gravure cylinders, a tubular iron or aluminum core (hollow roll) is used as a base, and a plurality of layers such as an underlying layer and a separation layer are formed on an outer peripheral surface of the base. On those layers, a copper plating layer or any other plating layer is formed. Then, cells are formed in the copper plating layer or any other plating layer by a laser exposure apparatus based on plate-making information, and then the resultant base is plated with chromium or any other substance for enhancing printing durability of the gravure cylinder. In this manner, plate making (production of a printing surface) is completed.

The applicant of the present application has already proposed a copper plating apparatus for a gravure cylinder, including a plating bath to be filled with a plating solution, chuck means for holding a long cylinder at both ends in a longitudinal direction so as to be rotated and energized, and accommodating the cylinder in the plating bath, and a pair of opposed insoluble electrodes which is vertically installed so as to face both side surfaces of the cylinder in the plating bath, and is supplied with a predetermined current, the pair of insoluble electrodes being brought close to both the side surfaces of the cylinder with a predetermined interval to perform plating on an outer peripheral surface of the cylinder, in which the insoluble electrode has a shape in which a lower part thereof is curved inward, and is capable of rotating about an upper end thereof, and in which a thickness of a plating layer on the outer peripheral surface of the cylinder is adjusted by controlling an interval of closeness to the cylinder (Patent Document 1).

In the plating apparatus to be used in the manufacture of a gravure cylinder, the hollow and tubular cylinder to be processed serves as a cathode, whereas each of the insoluble electrodes serves as an anode. In recent years, the cylinder to be processed has been upsized, and hence the current density is increased in the prior art insoluble electrodes as disclosed in Patent Document 1, thereby causing a problem that the burden on the insoluble electrodes becomes significant. The significant burden on the insoluble electrodes causes a problem that platinum or any other substance used in the insoluble electrodes are consumed rapidly.

In the prior art insoluble electrodes as disclosed in Patent Document 1, when chromium plating is performed, impurities such as trivalent chromium are generated, thereby requiring work of removing the impurities. As a result, there is a challenge to minimize the generation rate of the impurities.

PRIOR ART DOCUMENTS

Patent Document

Patent Document 1: WO 2012/043514 A1

SUMMARY OF THE INVENTION

Problems to be Solved by the Invention

The present invention has been made in view of the above-mentioned problems and challenge inherent in the prior art, and it is therefore an object of the present invention to provide a cylinder plating apparatus and a cylinder plating method, in which the distance between an insoluble electrode and a cylinder to be processed can be kept constant regardless of the diameter of the cylinder to be processed, and the surface area of the insoluble electrode is increased to reduce the current density of the insoluble electrode, thereby being capable of reducing burden on the insoluble electrode.

Means for Solving Problems

According to one embodiment of the present invention, there is provided a cylinder plating apparatus, including: a plating bath configured to store a plating solution; chuck means for holding a cylinder to be processed at both ends in a longitudinal direction thereof so as to be rotated and energized, and accommodating the cylinder to be processed in the plating bath; and a pair of opposed insoluble electrodes, which are vertically installed so as to face both side surfaces of the cylinder to be processed in the plating bath, and are configured to be supplied with a predetermined current, the pair of opposed insoluble electrodes being brought close to both the side surfaces of the cylinder to be processed with predetermined intervals to plate an outer peripheral surface of the cylinder to be processed, each of the pair of opposed insoluble electrodes having a shape in which at least a lower part thereof is curved inward, at least the lower part including a comb-like portion, the pair of opposed insoluble electrodes facing each other in a staggered pattern so that projections of the comb-like portion of one of the pair of opposed insoluble electrodes are located at positions of recesses of the comb-like portion of another one of the pair of opposed insoluble electrodes, the each of the pair of opposed insoluble electrodes being configured to rotate about an upper end of the each of the pair of opposed insoluble electrodes so that a distance of closeness of the each of the pair of opposed insoluble electrodes to the outer peripheral surface of the cylinder to be processed is adjustable depending on a diameter of the cylinder to be processed.

With this configuration, the distance between the insoluble electrode and the cylinder to be processed can be kept constant regardless of the diameter of the cylinder to be processed. The lower part of the insoluble electrode has the comb-like portion, and the insoluble electrodes face each other in a staggered pattern so that the projections of the comb-like portion of one of the insoluble electrodes are located at the positions of the recesses of the comb-like portion of another one of the insoluble electrodes. Thus, the surface area of the insoluble electrode is increased. As a result, the current density of the insoluble electrode is reduced as compared to the prior art to prolong its life.

It is preferred that the each of the pair of opposed insoluble electrodes have a curved shape conforming to a curvature of the outer peripheral surface of the cylinder to be processed.

Further, it is preferred that the each of the pair of opposed insoluble electrodes be a mesh-like electrode. The mesh-like electrode is used because an electric field is generated on the back surface of the insoluble electrode as well as the front surface thereof, and hence the surface area effective as the electrode is increased in the insoluble electrode, with the result that the current density of the insoluble electrode is reduced to prolong its life.

It is preferred that the plating solution be a copper plating solution or a chromium plating solution, and that the cylinder to be processed be a hollow and tubular gravure plate-making cylinder. It is preferred that the copper plating solution contain copper sulfate, sulfuric acid, chlorine, and an additive, that the specific gravity of the copper plating solution and the concentration of sulfuric acid be measured, that water be supplied when the specific gravity is excessively high, and that cupric oxide powder be supplied when the concentration of sulfuric acid is excessively high. Thus, it is not necessary to perform periodic maintenance of the copper plating solution and disposal of waste liquid unlike the prior art. It is preferred that impurities be removed from the copper plating solution through a filter. Further, the chromium plating solution may be used as the plating solution to perform chromium plating. When the chromium plating is performed, there is an advantage that generation of impurities such as trivalent chromium can be delayed.

According to one embodiment of the present invention, there is provided a cylinder plating method, including plating an outer peripheral surface of a cylinder to be processed through use of the above-mentioned cylinder plating apparatus.

According to one embodiment of the present invention, there is provided a gravure cylinder, which is plated by the above-mentioned cylinder plating method.

Advantageous Effects of the Invention

According to the present invention, it is possible to achieve a remarkable effect of providing the cylinder plating apparatus and the cylinder plating method, in which the distance between the insoluble electrode and the cylinder to be processed can be kept constant regardless of the diameter of the cylinder to be processed, and the surface area of the insoluble electrode is increased to reduce the current density of the insoluble electrode, thereby being capable of reducing the burden on the insoluble electrode.

In the present invention, the burden on the insoluble electrode can be reduced as described above, and hence the life of the insoluble electrode can be prolonged as compared to the prior art, thereby providing a durability that is about twice as high as that of the prior art.

DESCRIPTION OF THE EMBODIMENTS

Figure 1:
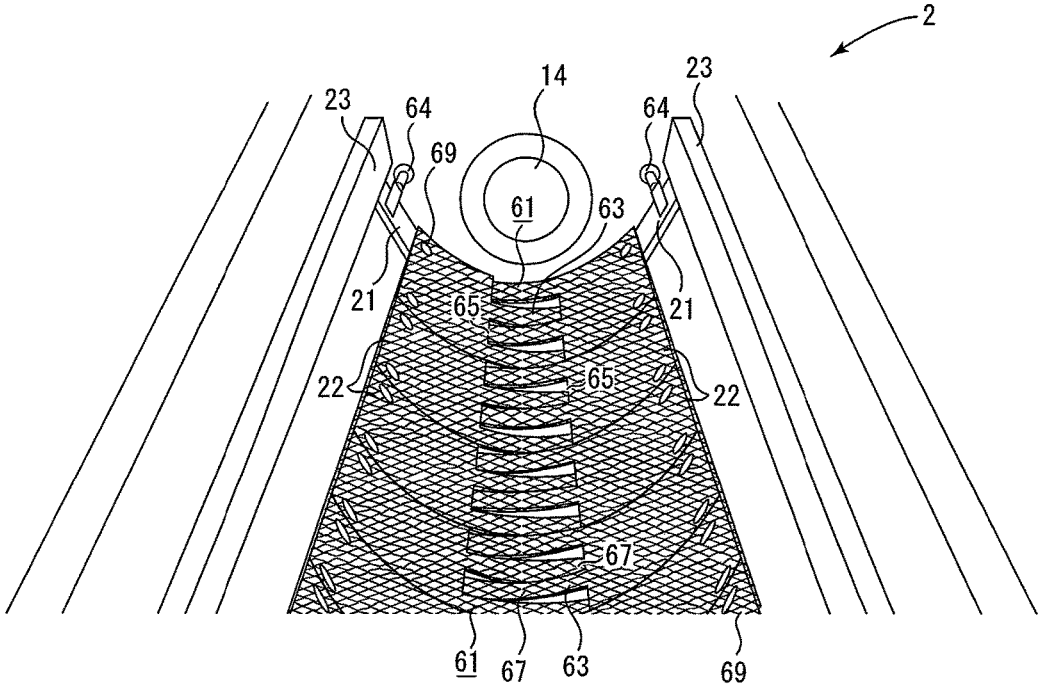
FIG. 1 is a schematic main part perspective view of an example of installation of insoluble electrodes in a cylinder plating apparatus of the present invention, for illustrating a state in which recesses of a comb-like portion of an insoluble electrode and projections of a comb-like portion of another insoluble electrode cross each other.
Figure 2:
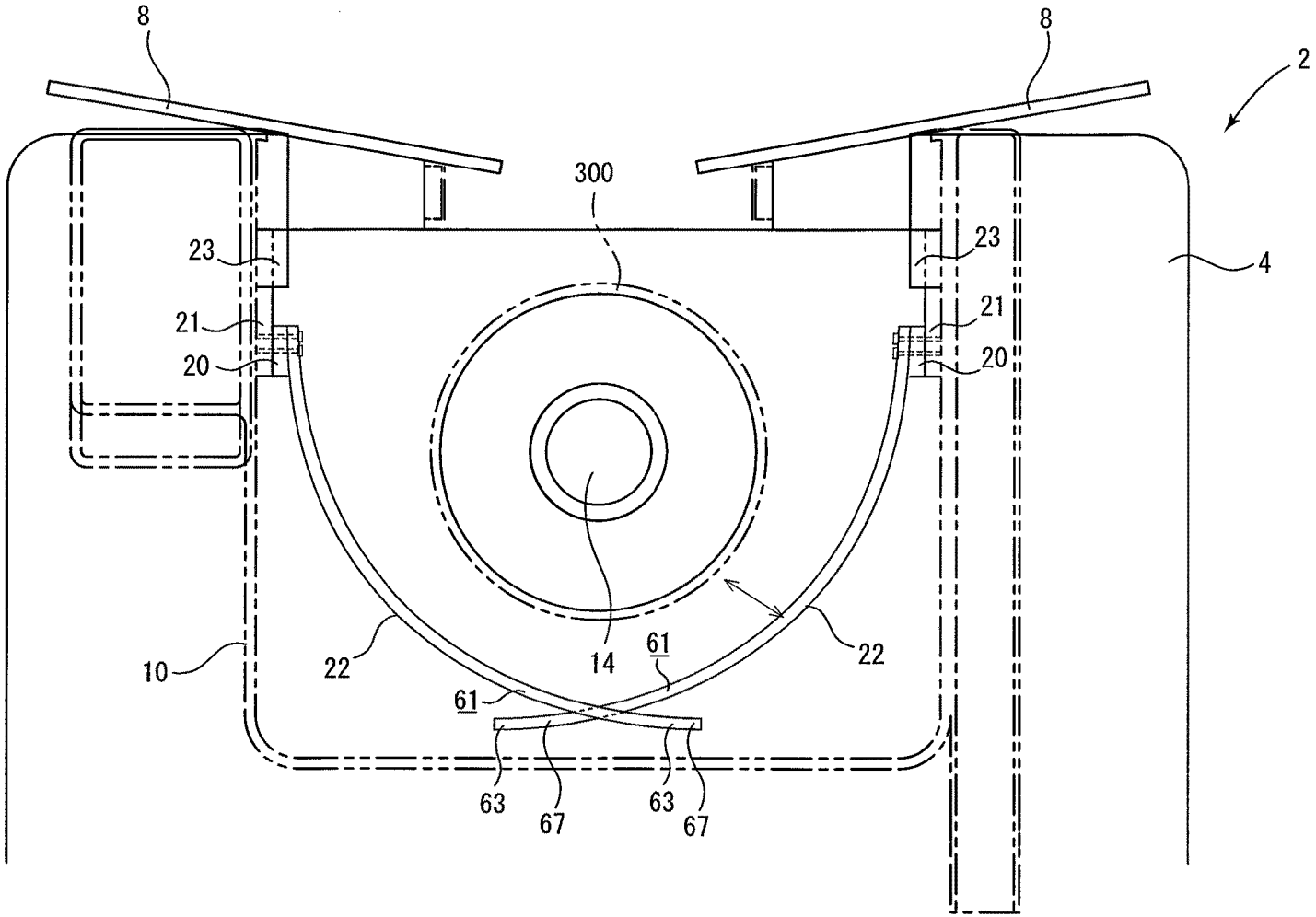
FIG. 2 is a schematic explanatory front view of the example of installation of the insoluble electrodes in the cylinder plating apparatus of the present invention illustrated in FIG. 1.

An embodiment of the present invention is described below with reference to the accompanying drawings, but illustrated examples are merely described as examples, and hence it is understood that various modifications may be made without departing from the technical spirit of the present invention.

FIG. 1 to FIG. 5 are views for illustrating an example of a basic configuration of a cylinder plating apparatus according to one embodiment of the present invention. In FIG. 1 to FIG. 5, reference symbol 2 represents a cylinder plating apparatus of the present invention. As a specific illustrated example, a chromium plating apparatus for a gravure cylinder is described. The cylinder plating apparatus 2 of the present invention is configured to perform chromium plating on an outer peripheral surface of a long, hollow, and tubular cylinder 300 to be processed. The cylinder plating apparatus 2 includes a plating bath 10, a pair of chuck means 14 and 14 for supporting the cylinder 300 to be processed, and a pair of insoluble electrodes 22 and 22 vertically installed in the plating bath 10 through intermediation of busbars 20 and 20. The plating bath 10 and the chuck means 14 have regular configurations substantially similar to those of the prior art apparatus (Patent Document 1), and redundant description is therefore omitted herein. The plating bath 10 is a bath for plating, which is filled with a chromium plating solution 304. The plating bath 10 is configured such that the gravure cylinder 300 is fully immersible in the chromium plating solution 304.

Collection ports 12 configured to collect the overflowed chromium plating solution 304 are formed on the periphery of the plating bath 10, and a reservoir 70 configured to store the chromium plating solution 304 in communication with the collection ports 12 is provided below the plating bath 10. A heater 86 and a heat exchanger 88 configured to keep the chromium plating solution 304 at a predetermined liquid temperature (for example, about 40° C.) are provided in the reservoir 70. Further, a filter 80 configured to remove impurities in the chromium plating solution 304, a pump P1 configured to pump up the chromium plating solution 304 from the reservoir 70 to circulate the chromium plating solution 304 through the plating bath 10, and other devices are provided in the reservoir 70.

The chuck means 14 and 14 are roll chuck devices configured to hold the cylinder 300 to be processed at both ends in a longitudinal direction thereof and accommodate the cylinder 300 to be processed in the plating bath 10. Each of the chuck means 14 and 14 includes a spindle 16 axially supported by a bearing 6, and a liquid-proof adapter 15 configured to prevent entry of the chromium plating solution 304. The chuck means 14 and 14 are driven to rotate at a predetermined speed (for example, about 120 rpm) through intermediation of a chain C and a sprocket 18 by a cylinder rotation motor 306 provided on a base 4, and are energizable so that the cylinder 300 to be processed serves as a cathode. In addition, a cover plate 8 freely openable and closable above the plating bath 10, an exhaust duct 11, and other components are provided as appropriate.

In the chromium plating apparatus 2 for a gravure cylinder of the present invention, as illustrated in FIG. 1, the busbars 20 and 20 are mounted to support bars 23 and 23 through intermediation of auxiliary members 21, and the insoluble electrodes (in the illustrated example, split electrodes) 22 and 22 are vertically installed to the busbars 20 and 20 so as to face both sides of the cylinder 300 to be processed, which is held by the chuck means 14 in the plating bath 10. A titanium plate coated with, for example, platinum or iridium on its surface is used as the insoluble electrode 22.

Further, a mesh-like electrode is used as the insoluble electrode 22. The mesh-like electrode is used because an electric field is generated on the back surface of the insoluble electrode 22 as well as the front surface thereof, and hence the surface area effective as the electrode is increased in the insoluble electrode 22, with the result that the current density of the insoluble electrode 22 is reduced to prolong its life. For example, in the insoluble electrode disclosed in Patent Document 1, the surface area of the insoluble electrode per bath of the cylinder plating apparatus is 11,000 $cm^2$, whereas in the cylinder plating apparatus 2 of the present invention, the surface area of the insoluble electrode per bath is 30,000 $cm^2$. In this manner, the surface area is increased exponentially. Further, the use of the mesh-like electrode facilitates the passage of the plating solution through the electrode, thereby providing an advantage in that the plating solution is smoothly supplied to the cylinder 300 to be processed.

As illustrated in FIG. 1 to FIG. 5, the cylinder plating apparatus 2 of the present invention includes the plating bath 10 configured to store the plating solution 304 (in the illustrated example, the chromium plating solution), the chuck means 14 and 14 for holding the cylinder 300 to be processed at both the ends in the longitudinal direction thereof so as to be rotated and energized, and accommodating the cylinder 300 to be processed in the plating bath, and the pair of opposed insoluble electrodes 22 and 22, which are vertically installed so as to face both side surfaces of the cylinder 300 to be processed in the plating bath 10, and are configured to be supplied with a predetermined current. The pair of insoluble electrodes 22 and 22 are brought close to both the side surfaces of the cylinder 300 to be processed with predetermined intervals to plate the outer peripheral surface of the cylinder 300 to be processed. The insoluble electrodes 22 and 22 have a shape in which at least lower parts 61 and 61 thereof are curved inward, and at least the lower parts 61 and 61 have comb-like portions 63 and 63. The insoluble electrodes 22 and 22 face each other in a staggered pattern so that projections 67 of the comb-like portion 63 of one of the insoluble electrodes 22 are located at positions of recesses 65 of the comb-like portion 63 of another one of the insoluble electrodes 22. The insoluble electrode 22 is configured to rotate about an upper end 69 of the insoluble electrode 22 so that the distance of closeness of each of the insoluble electrodes 22 and 22 to the outer peripheral surface of the cylinder 300 to be processed is adjustable depending on the diameter of the cylinder 300 to be processed.

The features of the present invention reside in that the insoluble electrodes 22 and 22 have a shape in which the lower parts thereof are curved inward, that at least the lower parts 61 and 61 have the comb-like portions 63 and 63, and that the insoluble electrodes 22 and 22 face each other in a staggered pattern so that the projections 67 of the comb-like portion 63 of one of the insoluble electrodes 22 are located at the positions of the recesses 65 of the comb-like portion 63 of another one of the insoluble electrodes 22.

The effect is enhanced as long as the lower part of each of the insoluble electrodes 22 and 22 has an inwardly curved shape. It is preferred that the lower part have a curved shape so as to conform to the curved outer peripheral surface of the cylinder 300 to be processed. Further, each of the insoluble electrodes 22 and 22 is configured to rotate about the upper end thereof, for example, about a rotation shaft provided in the plating bath 10. The thickness of the plating layer to be formed on the outer peripheral surface of the gravure cylinder is adjustable through control of the interval of closeness to the gravure cylinder 300. As a mechanism capable of rotating the insoluble electrodes 22 and 22, any well-known rotation mechanism only needs to be adopted. Alternatively, a mechanism as disclosed in, for example, Patent Document 1 may be adopted.

As illustrated in FIG. 1, the insoluble electrodes of the cylinder plating apparatus of the present invention are brought into a state in which the recesses of the comb-like portion of an insoluble electrode and the projections of the comb-like portion of another insoluble electrode cross each other.

Figure 3:
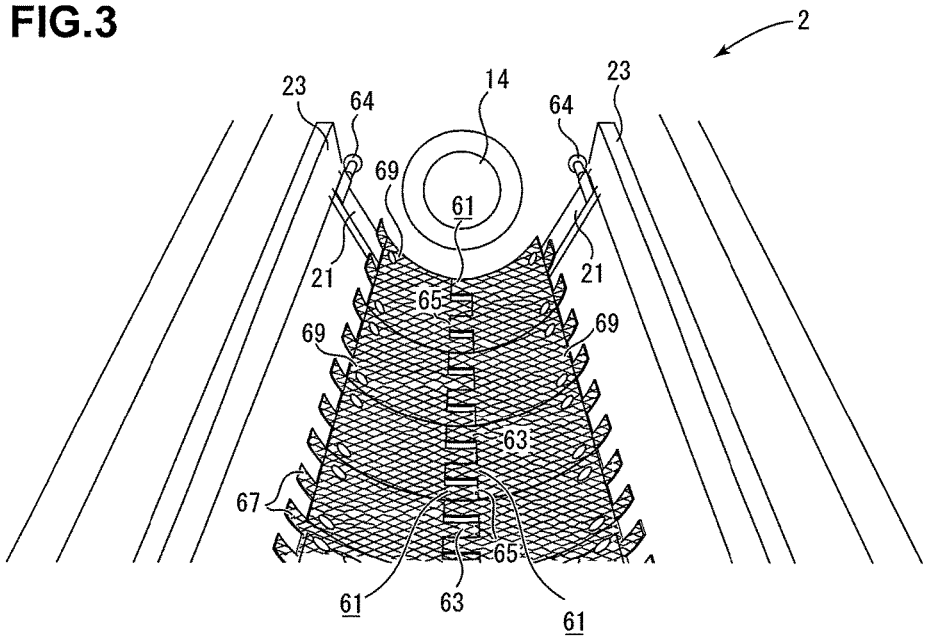
FIG. 3 is a schematic main part perspective view for illustrating a state in which the insoluble electrodes are rotated under the state of FIG. 1 to cause the recesses of the comb-like portion of an insoluble electrode and the projections of the comb-like portion of another insoluble electrode to cross each other even more deeply so that the cylinder plating apparatus is adaptable to a small-diameter cylinder.

When adapting the cylinder plating apparatus to a small-diameter cylinder (small in diameter), the insoluble electrodes are rotated to cause the recesses of the comb-like portion of an insoluble electrode and the projections of the comb-like portion of another insoluble electrode to cross each other even more deeply than in the state of FIG. 1 (FIG. 3).

Figure 4:
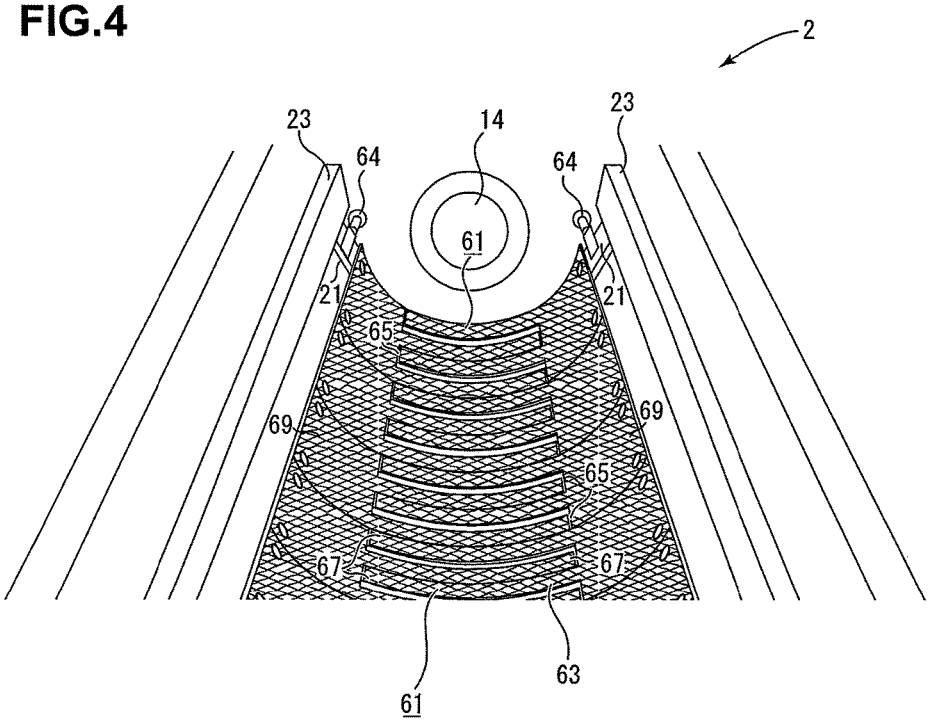
FIG. 4 is a schematic main part perspective view for illustrating a state in which the insoluble electrodes are rotated under the state of FIG. 1 to cause the recesses of the comb-like portion of an insoluble electrode and the projections of the comb-like portion of another insoluble electrode to become flush with each other so that the cylinder plating apparatus is adaptable to a large-diameter cylinder.
Figure 5:
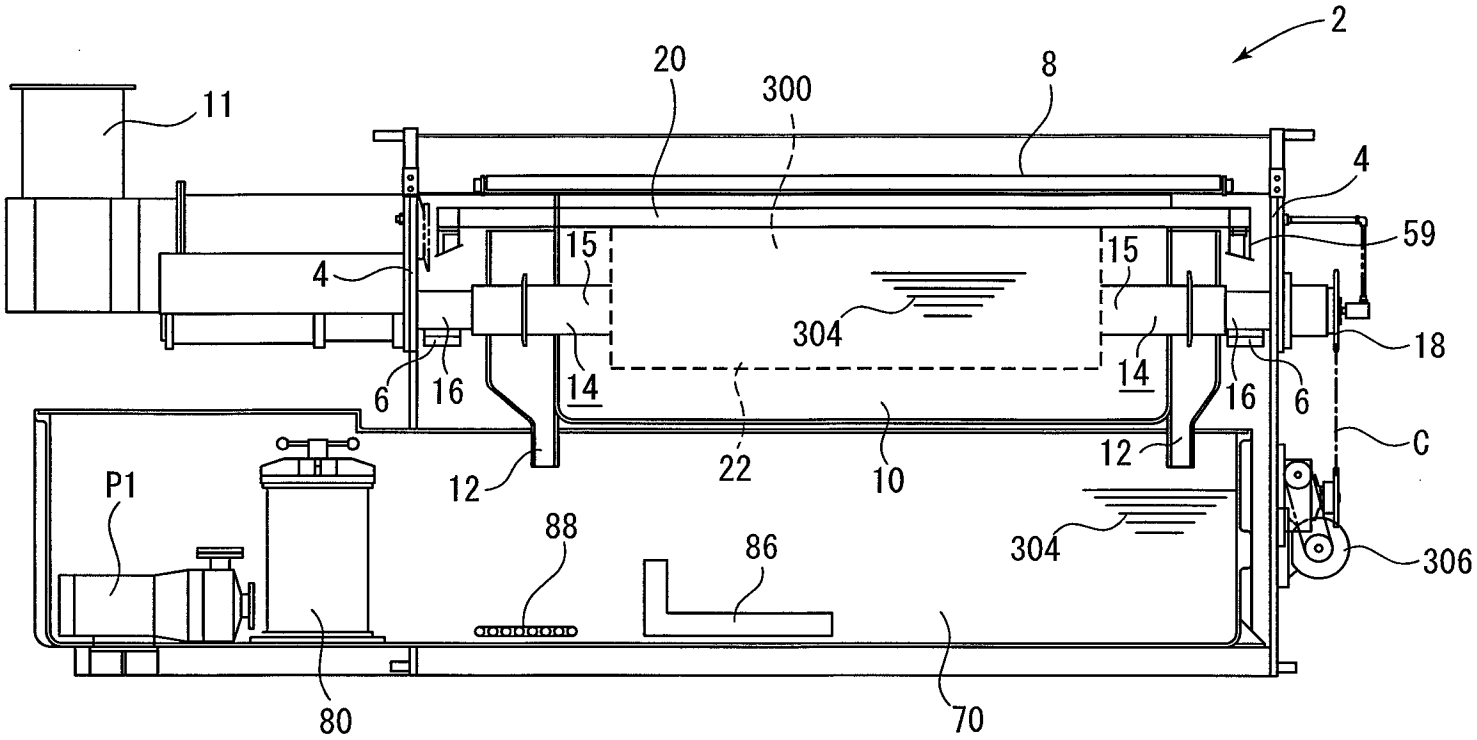
FIG. 5 is a schematic explanatory side view for illustrating an example of a basic configuration of the cylinder plating apparatus of the present invention.

When adapting the cylinder plating apparatus to a large-diameter cylinder (large in diameter), on the other hand, the insoluble electrodes are rotated to cause the recesses of the comb-like portion of an insoluble electrode and the projections of the comb-like portion of another insoluble electrode to become flush with each other (FIG. 4).

In this manner, in the present invention, the distance between each of the insoluble electrodes 22 and 22 and the cylinder 300 to be processed can be kept constant regardless of the diameter of the cylinder 300 to be processed, and the surface area of each of the insoluble electrodes 22 and 22 can be increased as compared to the prior art.

In the apparatus of the present invention, it is preferred that the insoluble electrode 22 be split into a large number of split electrodes 22A to 22C as disclosed in Patent Document 1. An electric potential is applied to each of the split electrodes 22A to 22C as disclosed in Patent Document 1 to control an electric potential to be applied to each of the end portions of the gravure cylinder 300. As a result, current concentration can be prevented at both the end portions of the cylinder, thereby being capable of significantly reducing the thickness of the plating layer of each of the end portions to a thickness of from about 30 μm to about 40 μm as compared to the prior art.

Figure 6:
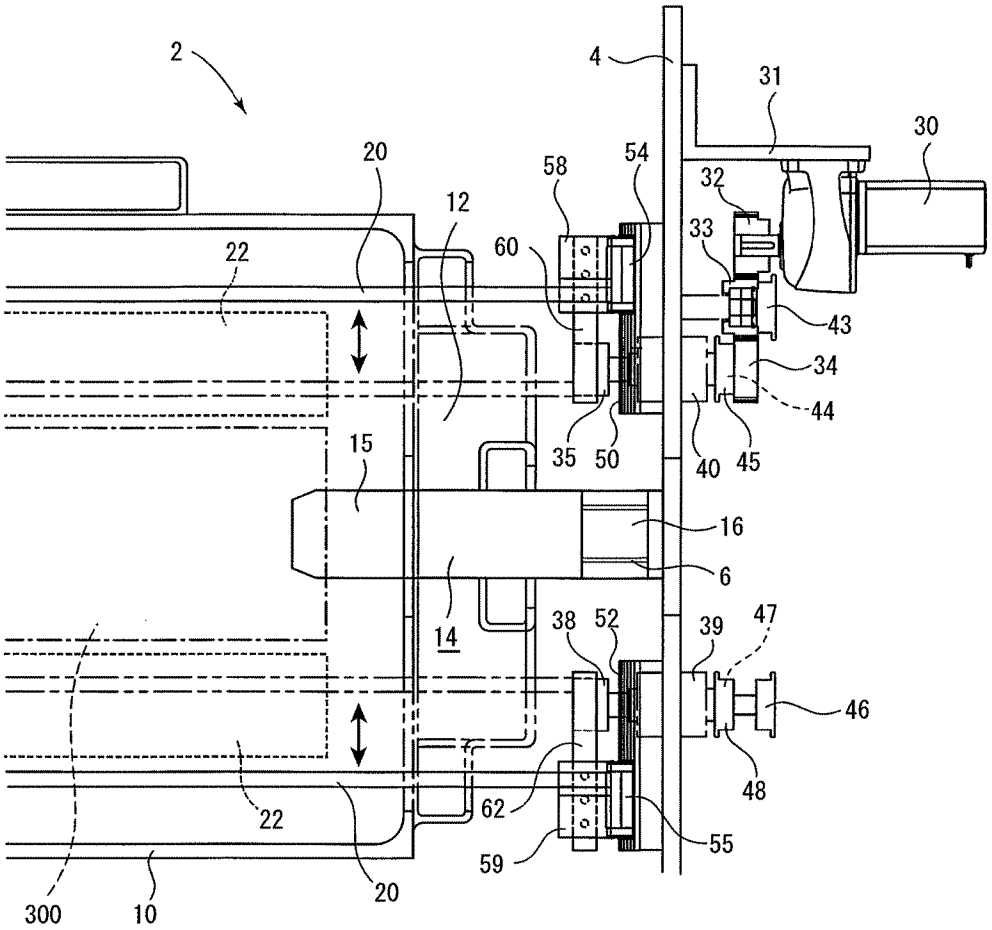
FIG. 6 is an explanatory plan view for illustrating an example of a slide mechanism for the insoluble electrodes of the present invention.
Figure 7:
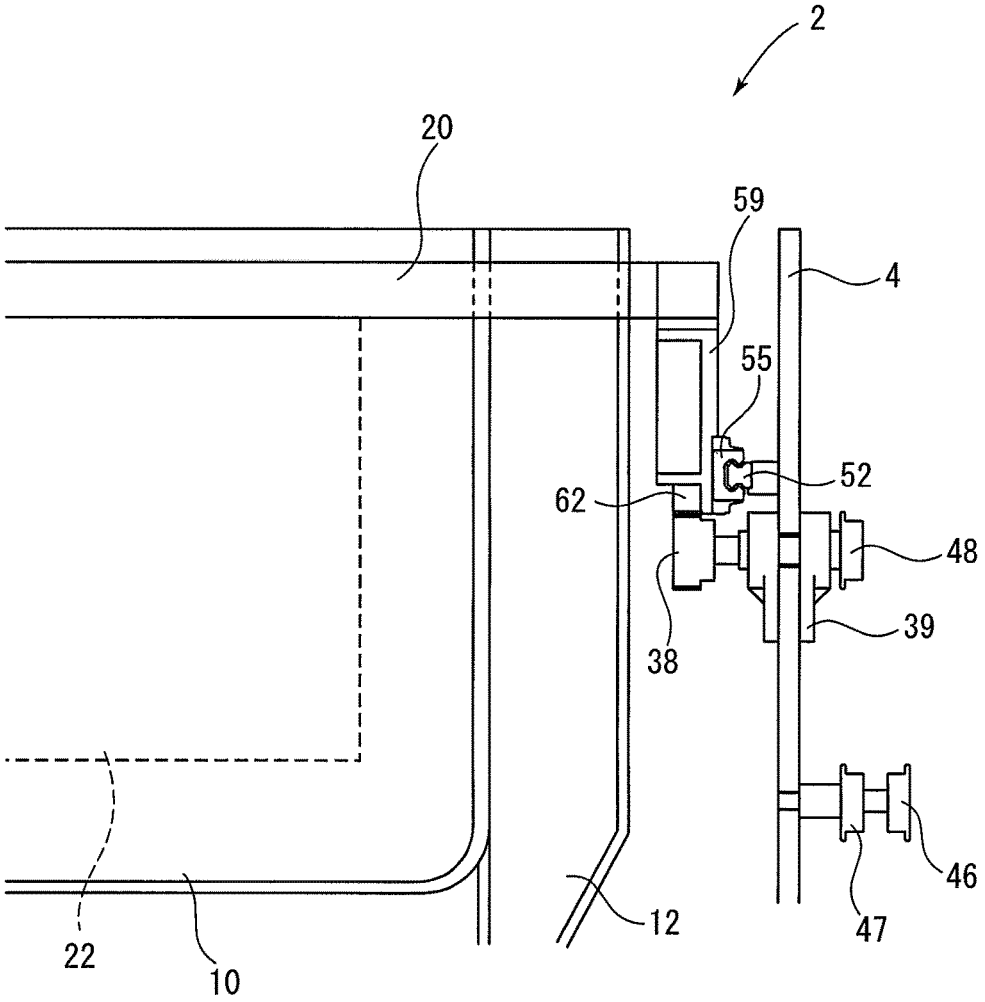
FIG. 7 is an explanatory plan view for illustrating the example of the slide mechanism for the insoluble electrodes of the present invention.
Figure 8:
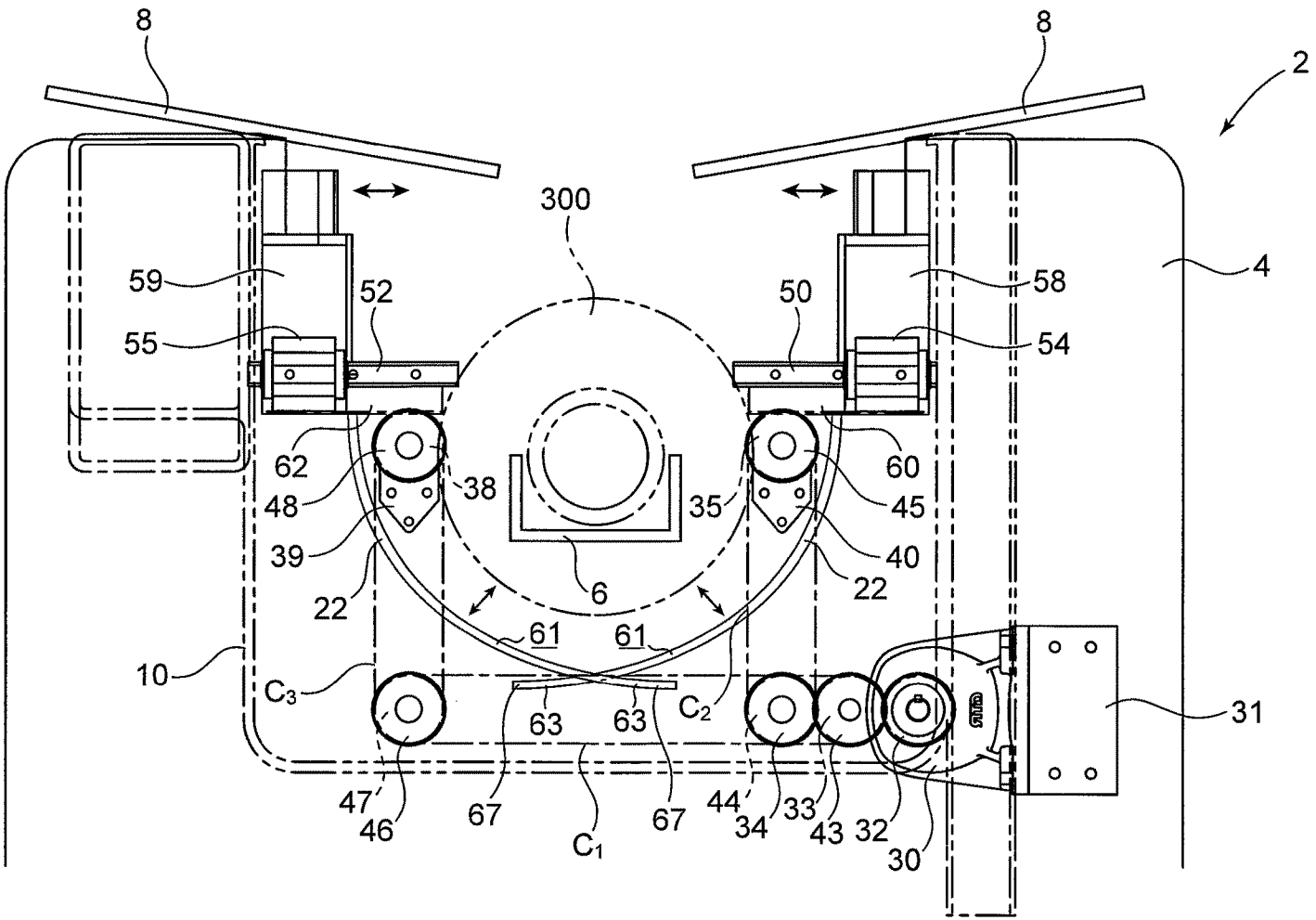
FIG. 8 is an explanatory front view for illustrating the example of the slide mechanism for the insoluble electrodes of the present invention.

As disclosed in Patent Document 1, there may be adopted a mechanism configured for allowing the pair of insoluble electrodes 22 and 22 to freely slide on both sides of the gravure cylinder 300. FIG. 6 to FIG. 8 are illustrations of an example of the mechanism configured for allowing the insoluble electrodes 22 and 22 to freely slide.

As illustrated in FIG. 6 to FIG. 8, the base 4 is provided upright on an outer side of the front surface of the plating bath 10, and linear rails 50 and 52 are provided on an inner wall surface of the base 4. Racks 60 and 62 are provided in parallel to the linear rails 50 and 52 so as to reciprocate through forward and reverse rotation of spur gears 35 and 38, and are connected to guide members 54 and 55, which are slidably engaged with the linear rails 50 and 52, through intermediation of mounting frames 58 and 59.

The spur gears 35 and 38 configured to reciprocate the racks 60 and 62 are arranged so that the spur gear 35 is firmly fixed to the base 4 with a fixture 40 so as to rotate coaxially with a sprocket 45 on an outer wall surface side of the base 4, whereas the spur gear 38 is firmly fixed to the base 4 with a fixture 39 so as to rotate coaxially with a sprocket 48 on the outer wall surface side of the base 4. Right below the sprocket 45, a sprocket 44 is provided so as to rotate coaxially with a spur gear 34, and right below the other sprocket 48, a sprocket 47 is provided so as to rotate coaxially with a sprocket 46. On the outer wall surface of the base 4, a geared motor 30 is installed through intermediation of a mounting angle bar 31, and a spur gear 32 is provided. A spur gear 33 is provided in engagement with the spur gear 32 so as to rotate coaxially with a sprocket 43. A chain $C_1$ is looped in engagement between the sprockets 43 and 46, a chain $C_2$ is looped in engagement between the sprockets 44 and 45, and a chain $C_3$ is looped in engagement between the sprockets 47 and 48. Thus, through forward and reverse drive of the geared motor 30, the spur gears 35 and 38 are rotated forwardly and reversely to reciprocate the racks 60 and 62. In synchronization with the reciprocal movement, the insoluble electrodes 22 and 22 are accurately slidable along the linear rails 50 and 52 (see FIG. 6 to FIG. 8).

The interval of closeness of each of the insoluble electrodes 22 and 22 to each of the side surfaces of the gravure cylinder 300 ranges from about 1 mm to about 50 mm, preferably from about 3 mm to about 40 mm, most preferably from about 5 mm to about 30 mm. From the viewpoint of achieving a uniform plating thickness, it may be preferred that the insoluble electrodes 22 and 22 be brought as close to the side surfaces of the gravure cylinder 300 as possible. However, the above-mentioned numerical ranges are set because, when the insoluble electrodes 22 and 22 are brought excessively close to the side surfaces of the gravure cylinder 300, there is a risk in that the insoluble electrodes 22 and 22 and the gravure cylinder 300 are brought into contact with each other during the plating.

It is desired that the cylinder plating apparatus 2 of the present invention further include an automatic plating solution management mechanism and a liquid supply mechanism as disclosed in Patent Document 1. Detailed description thereof is omitted herein.

EXAMPLES

The present invention is described in more detail below by way of examples, but it is understood that the examples are merely illustrative and not intended to be interpreted in a limited way.

Example 1

As a plating apparatus, an apparatus having the configuration illustrated in FIG. 1 to FIG. 5 was used. As a plating solution, a chromium plating solution containing chromic acid at a concentration of 250 g/L, sulfuric acid at a concentration of 2.5 g/L, and "CHRIO RX-ML" (produced by OKUNO CHEMICAL INDUSTRIES CO., LTD.) at a concentration of 50 mL/L as an additive was used. As chromium and additive components to be consumed through plating, "CHRIO RX-R" (produced by OKUNO CHEMICAL INDUSTRIES CO., LTD.) was supplied by an automatic supply device. As an insoluble anode, a titanium plate curved at its lower part and coated with platinum on its surface was used.

As a cylinder to be processed, a tubular base formed of an aluminum core having a circumferential length of 600 mm and a surface length of 1,100 mm was used. Both ends of the cylinder to be processed were chucked and mounted to the plating bath, and the insoluble electrodes were brought close to the cylinder to be processed up to 20 mm by a rotation mechanism controlled by a computer. The chromium plating solution was overflowed so that the cylinder to be processed was fully immersed. The number of revolutions of the cylinder to be processed was set to 100 rpm, the temperature of the plating solution was set to 55° C., the current density was set to 30 A/dm$^2$ (current of 1,980 A), and the voltage was set to 6 V. Under those conditions, plating was performed for 10 minutes, with the result that a plating film having a uniform thickness of 6 μm with no lumps or pits on the surface was obtained.

Example 2

As a plating apparatus, an apparatus having the configuration illustrated in FIG. 1 to FIG. 5 was used. As a plating solution, a copper plating solution was used.

As a cylinder to be processed, a tubular base formed of an aluminum core having a circumferential length of 600 mm and a surface length of 1,100 mm was used. Both ends of the cylinder to be processed were chucked and mounted to the plating bath, and the insoluble electrodes were brought close to the cylinder to be processed up to 20 mm by a rotation mechanism controlled by a computer. The copper plating solution was overflowed so that the cylinder to be processed was fully immersed. The number of revolutions of the cylinder to be processed was set to 250 rpm, the temperature of the plating solution was set to 45° C., the current density was set to 30 A/dm$^2$ (current of 1,980 A), and the voltage was set to 7 V. Under those conditions, plating was performed for 10 minutes, with the result that a plating film having a uniform thickness of 60 μm with no lumps or pits on the surface was obtained.

REFERENCE SIGNS LIST

2: cylinder plating apparatus, 4: base, 6: bearing, 8: cover plate, 10: plating bath, 11: exhaust duct, 12: collection port, 14: chuck means, 15: liquid-proof adapter, 16: spindle, 18: sprocket, 20: busbar, 21: auxiliary member,

22: insoluble electrode, 23: support bar, 30: geared motor, 31: mounting angle bar, 32, 33, 34, 35, 38: spur gear, 39, 40: fixture, 43, 44, 45, 46, 47, 48: sprocket, 50, 52: linear rail, 54, 55: guide member, 58, 59: mounting frame, 60, 62: rack, 61: lower part, 63: comb-like portion, 64: rotation shaft, 65: recess, 67: projection, 69: upper end, 70: reservoir, 80: filter, 86: heater, 88: heat exchanger, 300: cylinder to be processed, 302: rectifier, 304: plating solution, 306: cylinder rotation motor, C, $C_1$, $C_2$, $C_3$: chain, P1: pump.

The invention claimed is:

1. A cylinder plating apparatus, comprising:

a plating bath configured to store a plating solution;

a chuck means for holding a cylinder to be processed at both ends in a longitudinal direction thereof so as to be rotated and energized, and accommodating the cylinder to be processed in the plating bath; and a pair of opposed insoluble electrodes, which are vertically installed so as to face both side surfaces of the cylinder to be processed in the plating bath, and are configured to be supplied with a predetermined current, the pair of opposed insoluble electrodes being brought close to both the side surfaces of the cylinder to be processed with predetermined intervals to plate an outer peripheral surface of the cylinder to be processed, each of the pair of opposed insoluble electrodes having a shape in which at least a lower part thereof is curved inward, at least the lower part comprising a comb-like portion, the pair of opposed insoluble electrodes facing each other in a staggered pattern so that projections of the comb-like portion of one of the pair of opposed insoluble electrodes are located at positions of recesses of the comb-like portion of another one of the pair of opposed insoluble electrodes, each of the pair of opposed insoluble electrodes being configured to rotate about an upper end thereof so that a distance of closeness of each of the pair of opposed insoluble electrodes to the outer peripheral surface of the cylinder to be processed is adjustable depending on a diameter of the cylinder to be processed.

2. A cylinder plating apparatus according to claim 1, wherein each of the pair of opposed insoluble electrodes has a curved shape conforming to a curvature of the outer peripheral surface of the cylinder to be processed.

3. A cylinder plating apparatus according to claim 1, wherein each of the pair of opposed insoluble electrodes comprises a mesh-like electrode.

4. A cylinder plating apparatus according to claim 1, wherein the plating solution comprises a copper plating solution or a chromium plating solution, and the cylinder to be processed comprises a hollow and tubular gravure plate-making cylinder.

5. A cylinder plating method, comprising:

providing a cylinder plating apparatus comprising a plating bath configured to store a plating solution and a chuck means for holding a cylinder to be processed at both ends in a longitudinal direction thereof so as to be rotated and energized, and accommodating the cylinder to be processed in the plating bath, the cylinder plating apparatus further comprising a pair of opposed insoluble electrodes, which are vertically installed so as to face both side surfaces of the cylinder to be processed in the plating bath, and are configured to be supplied with a predetermined current, the pair of opposed insoluble electrodes being brought close to both the side surfaces of the cylinder to be processed with predetermined intervals to plate an outer peripheral surface of the cylinder to be processed, each of the pair of opposed insoluble electrodes having a shape in which at least a lower part thereof is curved inward, at least the lower part comprising a comb-like portion, the pair of opposed insoluble electrodes facing each other in a staggered pattern so that projections of the comb-like portion of one of the pair of opposed insoluble electrodes are located at positions of recesses of the comb-like portion of another one of the pair of opposed insoluble electrodes, each of the pair of opposed insoluble electrodes being configured to rotate about an upper end thereof so that a distance of closeness of each of the pair of opposed insoluble electrodes to the outer peripheral surface of the cylinder to be processed is adjustable depending on a diameter of the cylinder to be processed;

plating an outer peripheral surface of the cylinder to be processed via the cylinder plating apparatus.

6. A cylinder plating method, comprising:

providing a cylinder plating apparatus comprising a plating bath configured to store a plating solution and a chuck means for holding a cylinder to be processed at both ends in a longitudinal direction thereof so as to be rotated and energized, and accommodating the cylinder to be processed in the plating bath, the cylinder plating apparatus further comprising a pair of opposed insoluble electrodes, which are vertically installed so as to face both side surfaces of the cylinder to be processed in the plating bath, and are configured to be supplied with a predetermined current, the pair of opposed insoluble electrodes being brought close to both the side surfaces of the cylinder to be processed with predetermined intervals to plate an outer peripheral surface of the cylinder to be processed, each of the pair of opposed insoluble electrodes having a shape in which at least a lower part thereof is curved inward, at least the lower part comprising a comb-like portion, the pair of opposed insoluble electrodes facing each other in a staggered pattern so that projections of the comb-like portion of one of the pair of opposed insoluble electrodes are located at positions of recesses of the comb-like portion of another one of the pair of opposed insoluble electrodes, each of the pair of opposed insoluble electrodes being configured to rotate about an upper end thereof so that a distance of closeness of each of the pair of opposed insoluble electrodes to the outer peripheral surface of the cylinder to be processed is adjustable depending on a diameter of the cylinder to be processed;

using the cylinder plating apparatus to plate the cylinder.

7. A cylinder plating apparatus according to claim 2, wherein each of the pair of opposed insoluble electrodes comprises a mesh-like electrode.

8. A cylinder plating apparatus according to claim 2, wherein the plating solution comprises a copper plating solution or a chromium plating solution, and the cylinder to be processed comprises a hollow and tubular gravure plate-making cylinder.

9. A cylinder plating apparatus according to claim 3, wherein the plating solution comprises a copper plating solution or a chromium plating solution, and the cylinder to be processed comprises a hollow and tubular gravure plate-making cylinder.

10. A method according to claim 5, wherein each of the pair of opposed insoluble electrodes has a curved shape conforming to a curvature of the outer peripheral surface of the cylinder to be processed.

11. A method according to claim 5, wherein each of the pair of opposed insoluble electrodes comprises a mesh-like electrode.

12. A method according to claim 5, wherein the plating solution comprises a copper plating solution or a chromium plating solution, and the cylinder to be processed comprises a hollow and tubular gravure plate-making cylinder.

13. A method according to claim 6, wherein each of the pair of opposed insoluble electrodes has a curved shape conforming to a curvature of the outer peripheral surface of the cylinder to be processed.

14. A method according to claim 6, wherein each of the pair of opposed insoluble electrodes comprises a mesh-like electrode.

15. A method according to claim 6, wherein the plating solution comprises a copper plating solution or a chromium plating solution, and the cylinder to be processed comprises a hollow and tubular gravure plate-making cylinder.

* * * * *